United States Patent [19]

Porter

[11] 4,448,466

[45] * May 15, 1984

[54] LOW INSERTION FORCE CONNECTOR FOR PRINTED CIRCUIT BOARDS

[75] Inventor: Warren W. Porter, Escondido, Calif.

[73] Assignee: NCR Corporation, Dayton, Ohio

[ * ] Notice: The portion of the term of this patent subsequent to Oct. 26, 1999 has been disclaimed.

[21] Appl. No.: 320,280

[22] Filed: Nov. 12, 1981

[51] Int. Cl.[3] ..... H01R 23/68

[52] U.S. Cl. ..... 339/17 M; 339/75 MP; 339/95 R; 339/176 MP

[58] Field of Search ..... 339/17 M, 17 LM, 95 R, 339/95 D, 75 MP, 176 MP

[56] References Cited

U.S. PATENT DOCUMENTS

| | | | |
|---|---|---|---|
| 3,710,303 | 1/1973 | Gallager, Jr. | 339/75 MP |
| 4,118,094 | 10/1978 | Key | 339/75 MP |
| 4,221,448 | 9/1980 | Logerot | 339/75 MP |
| 4,355,856 | 10/1982 | Porter | 339/95 R |

FOREIGN PATENT DOCUMENTS

| | | | |
|---|---|---|---|
| 2423266 | 12/1974 | Fed. Rep. of Germany | 339/75 MP |
| 44-22981 | 9/1969 | Japan | 339/75 MP |
| 53-66348 | 12/1979 | Japan | 339/75 MP |
| 639056 | 12/1978 | U.S.S.R. | 339/75 MP |

*Primary Examiner*—John McQuade

*Attorney, Agent, or Firm*—J. T. Cavender; Edward Dugas; Floyd A. Gonzalez

[57] ABSTRACT

An electrical connector provides mechanical advantage in obtaining high contact force with low insertion force. A pin is utilized as a cantilever beam to provide high contact force. A carrier, which is activated by insertion of a printed circuit board or the like, includes a lever forming part of the electrical connection. A spring element acts on the carrier to insure the levers are not in the path of the printed circuit board until after the printed circuit board makes contact with the carrier. The lever is displaced by the insertion of the printed circuit board causing a deflection of the pin. The lever has contact points capable of causing a piercing action, thereby forming good electrical contacts.

5 Claims, 14 Drawing Figures

LOW INSERTION FORCE CONNECTOR FOR PRINTED CIRCUIT BOARDS

BACKGROUND OF THE INVENTION

This invention relates to an electrical connector and more particularly to a low insertion force connector having a contact arrangement which provides a good electrical contact for printed circuit boards having beveled edges.

In many systems and for a variety of reasons, many electronic elements, components, circuitry, and interconnections are presently mounted, deposited, printed, or otherwise formed on one or both sides of a board (a printed circuit board, PCB) or other suitable substrate. Electrical interconnections of the PCB or the like and a backpanel or the like of the system are generally accomplished by a connector.

These connectors generally include a housing which is bolted or otherwise affixed to the backpanel, and the housing is formed with a longitudinal slot for receiving one edge of the printed circuit board or the like. The connector is provided with a plurality of individual interconnection elements each of which is adapted to suitably contact the backpanel on one end, and to suitably contact the printed circuit board or the like on the other end. The electrical connections provided by these interconnection elements are formed in various well known manners with the connections to the backpanel being relatively permanent in comparison to the connections made with the printed circuit board or the like.

In many connector configurations, the interconnection elements are formed so that one end of each interconnection element protrudes through the backpanel and wire-wrapped or otherwise connected. Connections between the interconnection element and the PCB or the like are generally made by mechanically biasing the interconnection elements of the connector into engagement with the edge contacts of the printed circuit board or the like. This mechanical biasing force serves two purposes, the first being to provide the electrical connections and the second being to grip the printed circuit board or the like, and thus hold the PCB or the like in the connector. It should be apparent that the biasing force exerted by the interconnecting elements must be relatively high to insure that good conductive contacts are made and maintained. The high biasing force causes a high insertion force of the PCB or the like which becomes excessive when the number of the interconnection elements of the connector is of a large quantity, the problem of the high insertion force being the impetus behind the development of zero insertion force and low insertion force connectors.

Another problem with these connectors is that the contact areas of the edge contacts and the interconnecting elements will rub against each other with considerable force during insertion and removal of the printed circuit board or the like. Since the edge contacts of a typical printed circuit board are only a few thousandths of an inch thick, this rubbing action which occurs during insertion and removal of the printed circuit board tends to wear away the edge contacts and may well ruin a PCB after several insertions and removals. This rubbing action may also wear away high-cost precious metal on the surface of the interconnecting elements which invites poor electrical contacts or corrosion and can result in hard to detect failures of the equipment.

In view of these above stated problems several attempts have been made to produce what has become known in the art as zero or low insertion force connector. Generally, these zero or low insertion force connectors are provided with mechanical actuating mechanisms which move the contact area of the interconnections elements out of the insertion and removal path of the printed circuit board or the like and allow the interconnecting elements to move into engagement with the edge contacts after the printed circuit board or the like has been inserted. Such a zero or low insertion force connector is disclosed in U.S. Pat. No. 4,355,856, issued Oct. 26, 1982, entitled "Low Insertion Force Connector Using Non-Noble Metal Contact Plating," by Warren W. Porter, and assigned to the same assignee as the present application. The referenced Patent discloses an actuating mechanism which is activated by the insertion of a printed circuit board or the like causing interconnecting elements to move and make contact with edge contacts of the printed circuit board, resulting in a low insertion force connector and eliminating any rubbing or wiping action between the edge contacts of the printed circuit board and the interconnecting elements, the interconnecting elements having sharp edges for piercing the oxide layer of the edge contact thus forming good electrical contacts. However, when this connector is utilized in conjunction with a printed circuit board having beveled edges, a high probability exists that the connector will not operate correctly, i.e., the interconnection elements will not properly engage or make contact with the edge contacts of the printed circuit board because the edge contacts do not extend to the end of the printed circuit board but only to the start of the beveled edge.

Therefore, a need exists for a new and improved zero or low insertion force connector which allows the use of a printed circuit board having beveled edges, in addition to a printed circuit board having non-beveled edges, and simultaneously offers the advantages of the connector of the aforementioned U.S. Pat. No. 4,355,856.

SUMMARY OF THE INVENTION

In accordance with the present invention, a new low insertion force connector which may be used with printed circuit boards having beveled edges has been devised. The electrical connector for connecting to an edge contact of a printed circuit board or the like comprises a pin made of an electrically conductive resilient material, and an interconnection element positioned within the electrical connector for completing the operative connection between the pin to the edge contact of the printed circuit board or the like. The insertion of the printed circuit board or the like causes the interconnection element to rotate thereby causing the interconnection element to complete the operative connection. An element is included which applies a force to the interconnection element to achieve a ready state.

The electrical connector, for connecting to an edge contact of a printed circuit board or the like, includes a pin made of an electrically conductive resilient material and a carrier, made of an electrically insulative material which is actuated by insertion of the printed circuit board or the like. A lever, made of an electrically conductive material and being partially encased within the carrier, has two ends which are pointed or edged. The carrier is positioned within the electrical connector such that the first end of the lever makes a first contact point with the edge contact when the carrier is actuated by an insertion of the printed circuit board or the like. The carrier continues a rotation motion as the printed circuit board or the like is further inserted, and the second end of the lever makes a second contact point with the pin. The second end of the lever causes the pin to be deflected as a result of the rotation motion of the carrier. The deflection causes a force to be transmitted through the first and second contact points, thereby to permit a piercing action to occur at the first and second contact points. A rod is in contact with the carrier and is configured to exert a force on the carrier in a direction to insure a ready state.

A specific embodiment of the electrical connector includes an electrically insulative housing which has two sidewalls, a front wall, a back wall, a top wall, and a base whose base centerline is along a surface of the base and parallel to the front and back walls, the surface of the base forming an inside surface of the electrically insulative housing. The top wall has an aperture centered in the top wall for receiving a printed circuit board or the like having a plurality of terminal strips. The electrically insulative housing has a cavity formed by the two sidewalls, the front wall, the back wall, the top wall and the base. A plurality of electrically conductive pins are arranged in two rows and are sufficiently flexible for providing a cantilever action. The two rows are along the base, parallel to and on opposite, equidistant sides of the base centerline. Each of the plurality of electrically conductive pins are affixed in and perpendicular to the base, spaced equally apart within the row, and extend through the base a sufficient length to permit external connections to be made to the plurality of electrically conductive pins. The pins further extend into the cavity a sufficient length to maintain an operative connection to the corresponding terminal strip of the printed circuit board or the like when the printed circuit board or the like is fully inserted into the electrical connector. Connecting carriers, are each positioned within the cavity for completing the operative connection between each of the plurality of electrically conductive pins to a corresponding one of the terminal strips of the printed circuit board or the like. The insertion of the printed circuit board or the like causes the connecting carriers to rotate thereby causing the connecting carriers to complete the operative connection. A pair of rods, each rod corresponding to a respective connecting carrier and each rod having a first end which is firmly affixed at a point on the base and having a second end which extends beyond the connecting carrier such that a surface of the rod near the second end is in operative contact with the connecting carrier. The point on the base is located such that the rod is slightly deflected causing the rod to exert a force on the connecting carrier in a direction to insure the ready state of the electrical connector.

From the foregoing it can be seen that it is a primary object of the present invention to provide an electrical connector having a low insertion force.

It is another object of the present invention to provide a low insertion force electrical connector for use with printed circuit boards, including printed circuit boards having beveled edges.

It is still another object of the present invention to provide a low insertion force electrical connector for use with printed circuit boards having beveled edges while providing good electrical contacts.

These and other objects of the present invention will become more apparent when taken in conjunction with the following description, and attached drawings, wherein like characters indicate like parts and which drawings form a part of the present application.

DETAILED DESCRIPTION

In order to understand the operation, advantages, and features of the connector of the present invention, it would be advantageous to first describe the construction and operation of the prior art connector.

Figure 1:
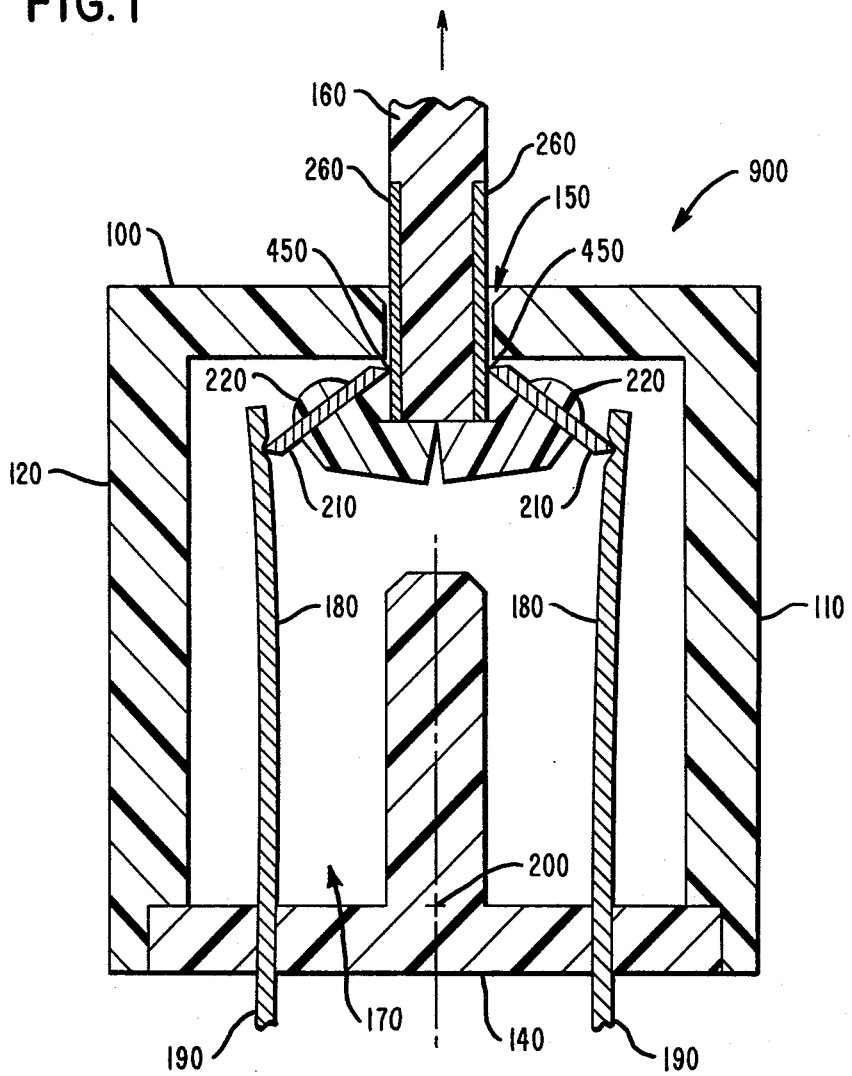
FIG. 1 is an end-view cross-section of the patented connector of the aforementioned U.S. Pat. No. 4,355,856 with the printed circuit board or the like partially inserted therein.

The construction of the connector 900 is shown in FIG. 1, the connector 900 being the same connector as that described in the aforementioned U.S. Pat. No. 4,355,856, issued Oct. 26, 1982, entitled, "Low Insertion Force Connector Using Non-Noble Metal Contact Plating," by Warren W. Porter also the inventor herein, and assigned to the same assignee as the present invention. FIG. 1 is an end-view cross-section of the patented connector 900 with the printed circuit board 160 or the like partially inserted therein. Referring to FIG. 1, the connector housing, comprising a top wall 100, a front wall 110, a back wall 120, two side walls (not shown, each side wall having a groove for guiding the insertion of a printed circuit board), and a base 140, is shown which is made of an electrically insulative material. The walls and base of the connector housing form a hollow or cavity 170 within the connector 900. Top wall 100 has an opening 150 for permitting the insertion of a printed circuit board (PCB) 160 or the like into the connector 900, the PCB 160 having edge contacts or terminal strips 260.

Two rows of pins 180 are permanently fixed in the base 140 which extends a length outside the connector housing 190 through the base 140 and into the cavity 170. The two rows are on opposite sides of a base centerline 200 and equidistant therefrom, the base centerline 200 being along the base surface and parallel to the front wall 110 and the back wall 120. The pins 180 are spaced apart equally within the row.

There is an electrically conductive lever 210 for each pin 180 providing the interconnection between the edge contact 260 and the pin 180, each lever 210 being partially encased in a lever carrier 220, or simply referred to herein as a carrier 220, made of an electrically insulative material, with both ends of the lever 210 extending outside the carrier 220 and both ends having a sharp point or edge. Each pin 180 extends far enough into the cavity 170 such that the corresponding lever 210 always maintains pin contact. Two carriers 220 are positioned within cavity 170, such that the levers can rotate in a plane substantially perpendicular to the base centerline 200. The pin 180 is capable of being deflected as a cantilever beam when a force is applied.

Figure 2:
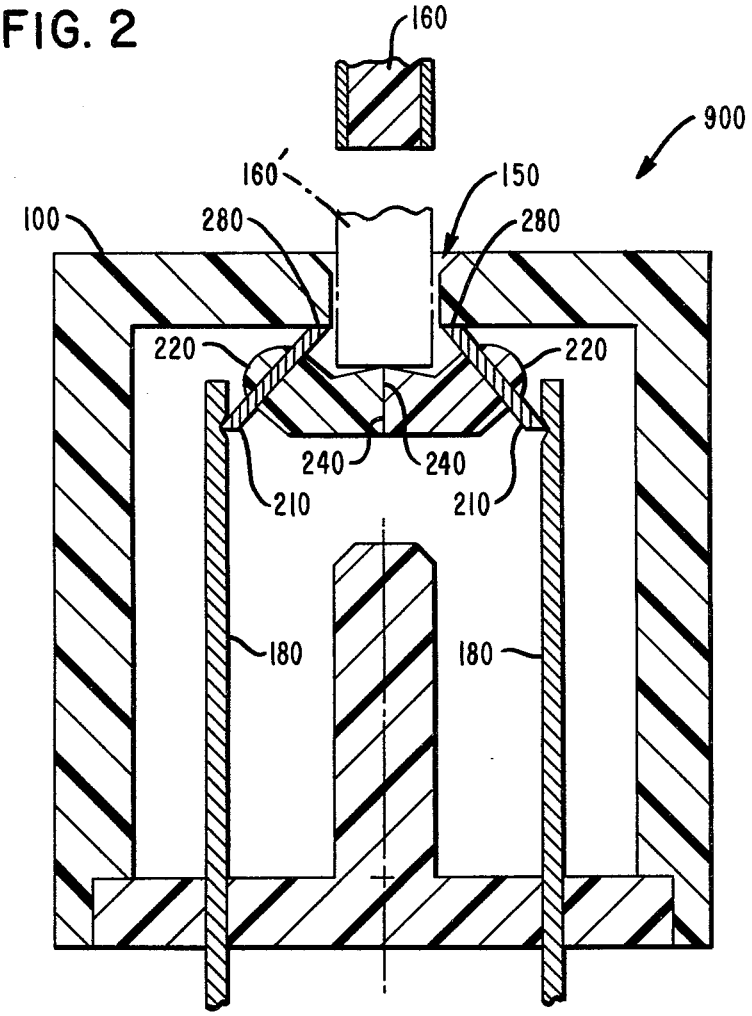
FIG. 2 is an end-view cross-section of the patented connector with the printed circuit board withdrawn and the connector in the initial or ready state and ready to receive the PCB.

The operation of the patented connector 900 will now be described in conjunction with an insertion of the PCB 160. Referring to FIG. 2, the PCB 160 is inserted into opening 150 and travels beyond the edges of levers 210 to the position depicted by PCB 160' where initial contact is made with carriers 220, the carriers 220 being shaped such that a portion extends in the path of travel of PCB 160. Referring back to FIG. 1, the PCB 160 continues to travel, causing rotation of the carriers 220 such that the edges of the levers 210, which were shown initially resting upon the inner surface of top wall 100, begin to make contact at contact points 450 with their corresponding edge contacts 260 (or terminal strips) of PCB 160. Such rotation also causes a force against pins 180 by levers 210, thereby deflecting the pins 180 from an initial or ready state. As PCB 160 is further inserted into connector 900, the leading edge of PCB 160 continues to push against carriers 220, and together with the contact point 450 made between levers 210 and edge contacts 260, the carriers 220 are rotated further, the initial contact points 450 being maintained throughout insertion of PCB 160 by the knife-like action of the sharp edges of levers 210, until the PCB 160 is fully inserted.

Of special significance is the ready state. Referring to FIG. 2 the patented connector 900 is shown in the ready state. In the ready state, i.e. a condition in which the connector is ready for the PCB 160 insertion, the two carriers 220 are held in position by the force exerted by the pins 180. The pins 180 in the ready state are slightly deflected causing the two carrier surfaces 240 to press against one another, thereby holding carriers 220 in equilibrium between the pins 180. The sharp edges of the levers 210 hold the levers 210 at a fixed point on the pins 180. The other end of the lever 210 is just outside opening 150 (i.e., does not extend into the opening 150), and is in contact with the inside surface 280 of top wall 100. In this configuration, the levers 210 are not in the path of PCB travel. If the ready state is not achieved, i.e. the levers 210 remain within the path of PCB travel, such condition can result in improper connector 900 operation and also can result in jamming the levers of the connector 900 during the next PCB 160 insertion.

Figure 3:
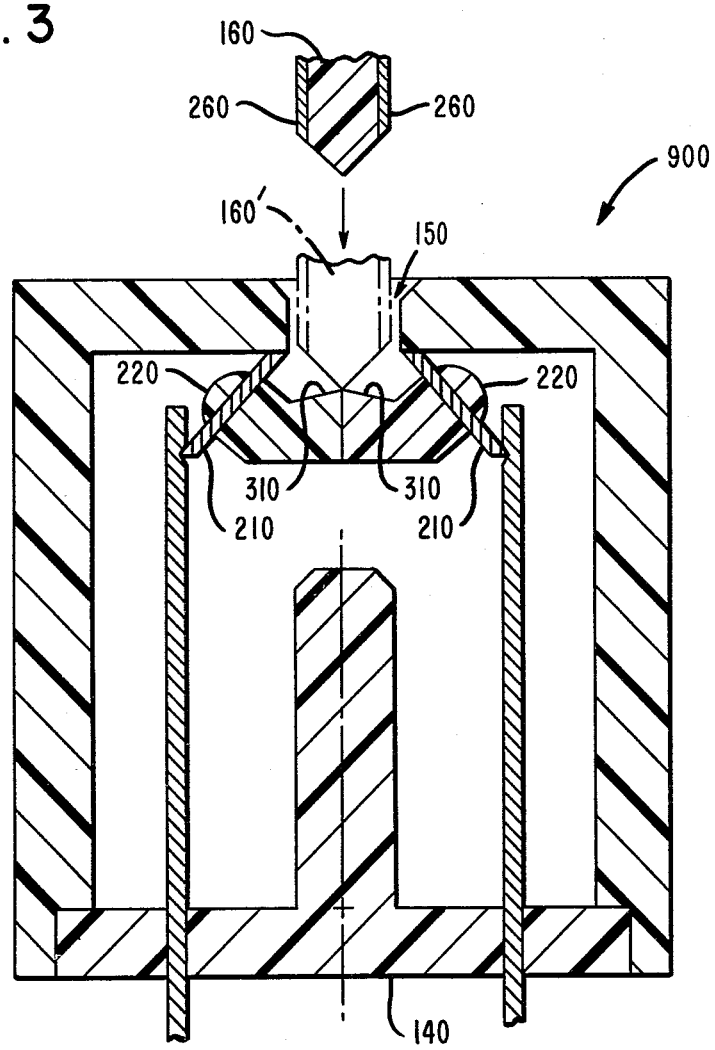
FIG. 3 is an end-view cross-section of the patented connector showing an initial insertion position of a PCB having beveled edges.

Referring to FIG. 3, it can be seen that the connector 900 may operate improperly for PCBs 160 having beveled edges. For the geometry of the connector 900 and the carriers 220 as shown, it can be seen that as the PCB 160 is inserted, and levers 210 start to rotate as the PCB 160 is pushed against lever carriers 220, the levers 210 will engage the beveled surface of the PCB 160 and will not contact the edge connectors 260 because the edge connections do not extend to the end of the board 160. Therefore, in order to insure proper contact is made against the edge connectors 260, the carriers 220 are shaped such that the portion of the carrier 220 which extends into the path of travel is located deeper into the connector, i.e. surface 310 is further away from opening 150 and closer to the base 140. The end of the PCB 160 engaging surface 310, which is now lower in the connector, will place edge connectors 260 in alignment with the points of levers 210 insuring contact when carriers 220 are rotated.

Figure 4:
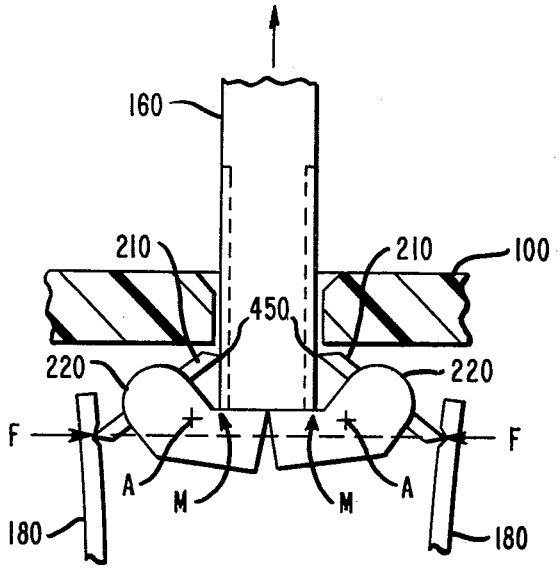
FIG. 4 is a partial end-view cross-section of the patented connector depicting a stable ready state condition.

However, because of the modified shape of carrier 220, the ready state may be more difficult to achieve, as will be described in conjunction with FIGS. 4 and 5. FIG. 4 shows a portion of the end-view cross-section of the patented connector 900. As mentioned above, it is important that the connector 900 achieve the ready state when the PCB 160 is extracted. As PCB 160 is extracted, the carriers 220 rotate as a result of maintaining the fixed contact point 450 with PCB 160. At the point of extraction of PCB 160 as shown in FIG. 4, the contact point 450 with PCB 160 is about to be broken. At this point, the rotation of carriers 220 to the ready state is a result of the force F being applied by the deflected pins 180. Since point A, the approximate center of gravity or centroid of the carriers 220, which may be determined empirically, is above the line of force F, a moment M is produced causing a rotation of the carriers to the ready state.

Figure 5:
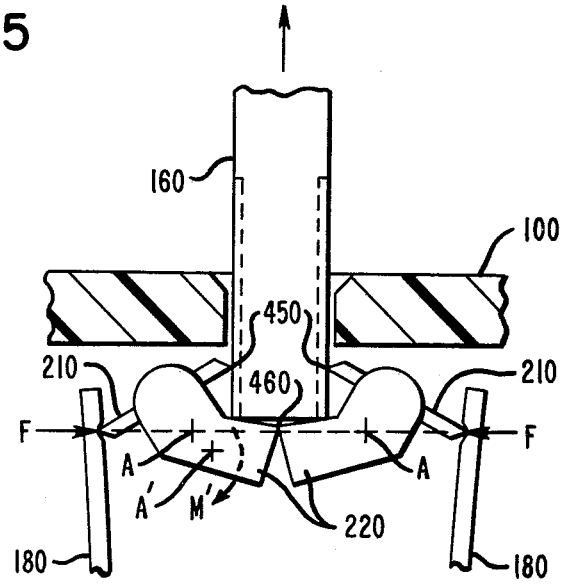
FIG. 5 is a partial end-view cross-section of the patented connector, having modified carriers for use with printed circuit boards with beveled edges, depicting a condition resulting in an unstable ready state.

Referring to FIG. 5, there is shown a partial end-view cross-section of a patented connector 900 having modified carriers 220, shaped to permit the PCB 160 to be inserted further into the connector before the modified carriers 220 rotate. Once again, at the point of extraction of PCB 160 as shown in FIG. 5, contact point 450 is about to be broken. The rotation of carriers 220 up to this point has been a result of the extraction process, with the contact points 450 being fixed with the PCB 160. At this point, the rotation of carriers 220 will be as a result of force F being applied by the deflected pins 180. However, since point A, the approximate center of gravity or centroid of the carriers 220, which may be determined empirically, is on the line of the applied force F, no rotational motion will be produced. Translational motion may be produced until the carriers are in contact with each other at point 460. If the carriers are modified still further to permit a deeper insertion of PCB 160, the centroid of the modified carriers 220 may be at a point A' below the force line and produce a counter-rotational moment M' shown by the dotted circular line away from the ready state.

Figure 6:
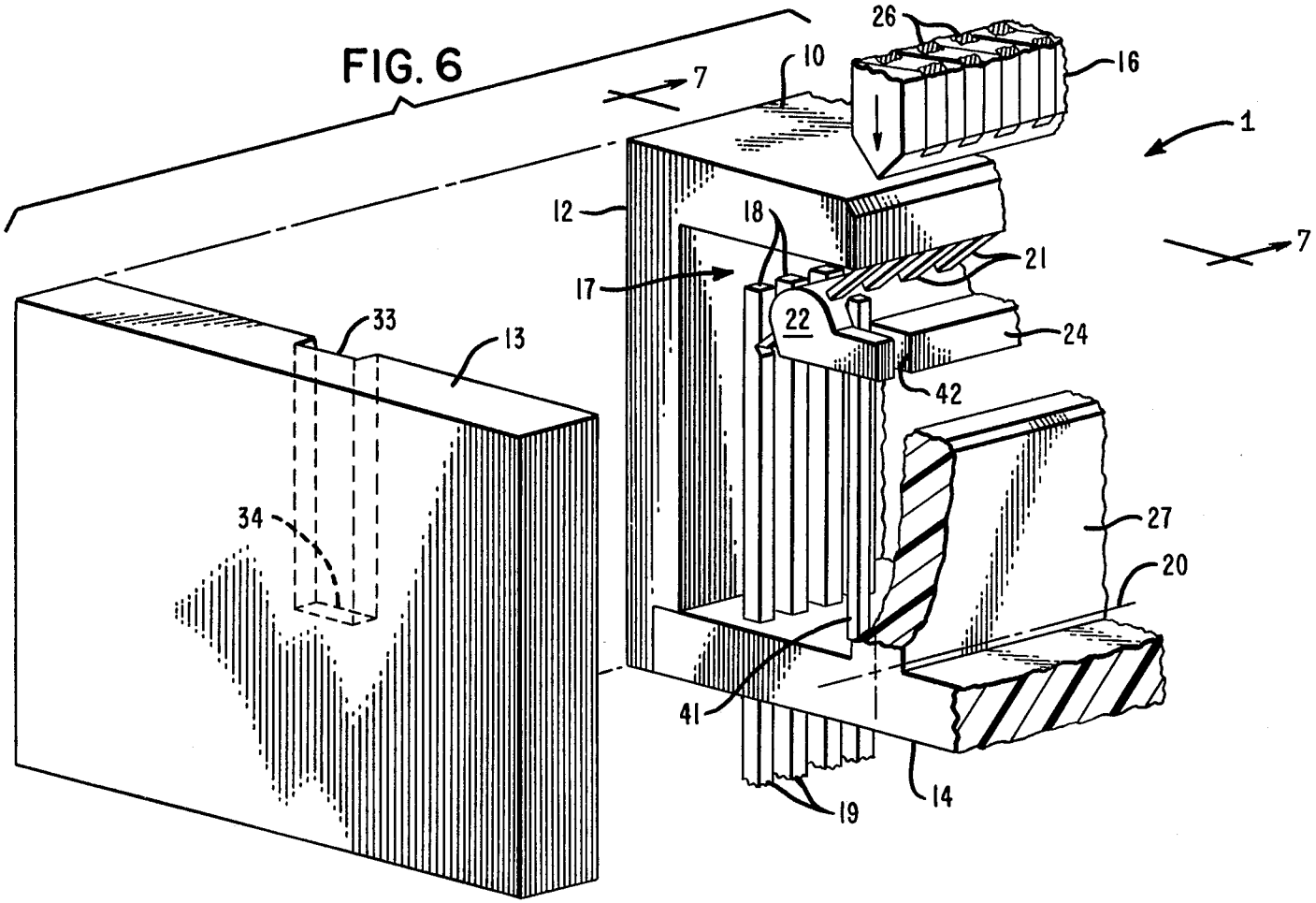
FIG. 6 is a cut-out partial section view of the total connector assembly.
Figure 7A:
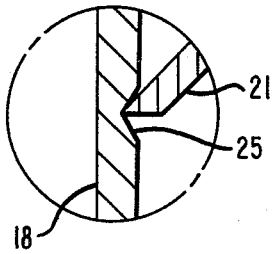
FIG. 7A is a magnified view of the encircled contact point of FIG. 7.
Figure 7:
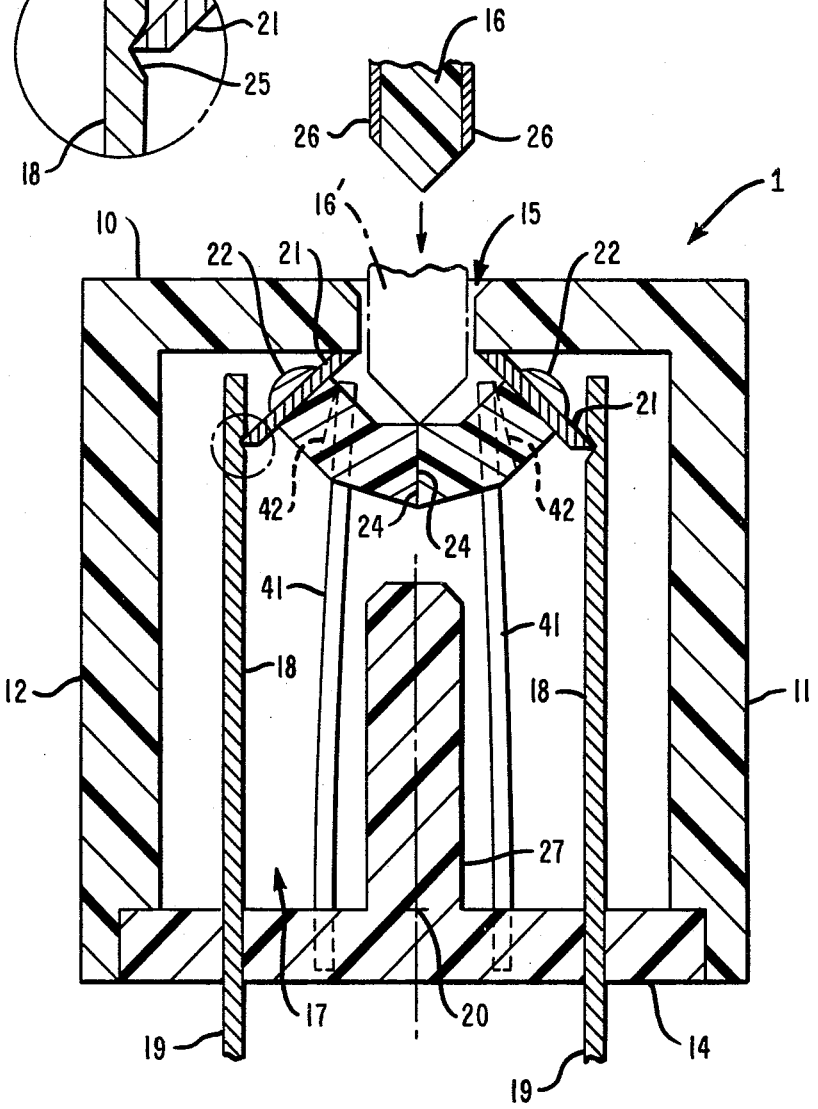
FIG. 7 is an end-view cross-section of the connector assembly of FIG. 6 taken along the section line 7—7 without the printed circuit board inserted.

As a result, in order to insure that the ready state is attained, the patented connector is modified to include a spring element. The connector of the present invention will now be described. The construction of the preferred embodiment connector 1 of the present invention is shown in FIGS. 6 and 7. FIG. 6 is a partial cut-out section view of the total connector assembly and FIG. 7 is an end-view cross-section of the connector 1 without the printed circuit board 16 or the like inserted. Referring to FIGS. 6 and 7, the connector housing, comprising a top wall 10, a front wall 11, a back wall 12, two side walls 13 (one is shown in FIG. 6) having a groove 33 for guiding the insertion of a printed circuit board, and a base 14, is shown which is made of an electrically insulative material. The walls and base of the connector housing form a hollow or cavity 17 within the connector 6. Top wall 10 has an opening 15 for permitting the insertion of a printed circuit board (PCB) 16 or the like into the connector 1, the PCB 16 having edge contacts or terminal strips 26.

In the preferred embodiment, two rows of pins 18 are permanently fixed in the base 14 which extends a length outside the connector housing 19 through the base 14 and into the cavity 17. The two rows are on opposite sides of a base centerline 20 and equidistant therefrom, the base centerline 20 being on the base surface and parallel to the front wall 11 and the back wall 12. The pins 18 are spaced apart equally within the row. It will be recognized by those skilled in the art that many alternative configurations may be devised within the true scope of the invention, including, a single pin, a single row of pins, or a row or rows of pins not spaced apart equally.

There is an electrically conductive lever 21 for each pin 18 providing the interconnection between the edge contact 26 and the pin 18, each lever 21 being partially encased in a lever carrier 22, or simply referred to herein as a carrier 22, made of an electrically insulative material, with both ends of the lever 21 extending outside the carrier 22 and both ends having a sharp point or edge. Each pin 18 extends far enough into the cavity 17 such that the corresponding lever 21 always maintains pin contact. Two carriers 22 are positioned within cavity 17, such that the levers can rotate in a plane substantially perpendicular to the base centerline 20. The pin 18 is capable of being deflected as a cantilever beam when a force is applied, the cantilever beam action to be described hereinunder. In addition, spring elements in the form of a rod 41, which is resilient, are placed within the cavity 17. The rod 41 is affixed to base 14 at one end, and the other end is allowed to extend beyond a slot 42 in carrier 22 such that a surface near this end is in contact with the carrier 22. The rod is slightly deflected to exert a force against the carrier such that, without the PCB 16 inserted into the connector 1, a moment is produced to insure the ready state of the connector as described above, the force being large enough to insure the ready state and small enough that it does not substantially contribute to the insertion force. At least one rod is utilized for each carrier. Thus, in the ready state, i.e. a condition in which the connector is ready for the PCB 16 insertion, the two carriers 22 are held in position by the moment produced between the force exerted by the pins 18 and the force exerted by the rods 41 as described above. The pins 18 in the ready state are slightly deflected, the moment produced by the action of the pins 18 and rods 41 causing the two carrier surfaces 24 to press against one another, thereby holding carriers 22 in equilibrium between the pins 18. It will be recognized by those skilled in the art that many alternatives exist for implementing the spring element for holding the carrier 22 in the ready position, including a plastic spring molded as part of the connector body ends.

The sharp edges of the levers 21 hold the levers 21 at a fixed point on the pins 18. As shown in FIG. 7A, a notch 25 can be placed in pin 18 to insure the lever 21/pin 18 position is maintained, the notch 25 being configured so as not to interfere with lever 21 rotation. The other end of the lever 21 is just outside opening 15 and is in contact with the inside surface of top wall 10. The carrier 22 is so shaped that is doesn't interfere with the lever 21/pin 18 contact during any lever 21 rotation, the rotation of the lever 21 will be described in detail hereinunder. The carrier 22 is further shaped such that a portion of the carrier 22 extends in the path taken by the PCB 16 during insertion. This portion of the carrier 22 is placed at a distance away from opening 15 such that the PCB 16 must be inserted deep enough into the connector 1 before contacting carriers 22 to insure proper contact will be made between levers 21 and edge contacts 26. The levers 21, pins 18, and edge contacts 26 may be made of an electrically conductive noble or non-noble metal. Again it will be recognized by those skilled in the art that, although the preferred embodiment shows the ends of the lever 21 having a chisel-like end configuration, the ends of the lever 21 may be configured to many different shapes while providing a good contact point with the pin 18 and the edge contact 26 respectively, the shapes including pointed, square edged, conical, and the like.

FIG. 7 shows the connector 1 in the ready state. The levers 21 are in the position as mentioned above such that the PCB 16 can travel beyond the edges of levers 21 to the point depicted by PCB 16' where initial contact is made with carriers 22, the carriers 22 being shaped such that a portion extends in the path of travel of PCB 16 as mentioned above.

Figure 8:
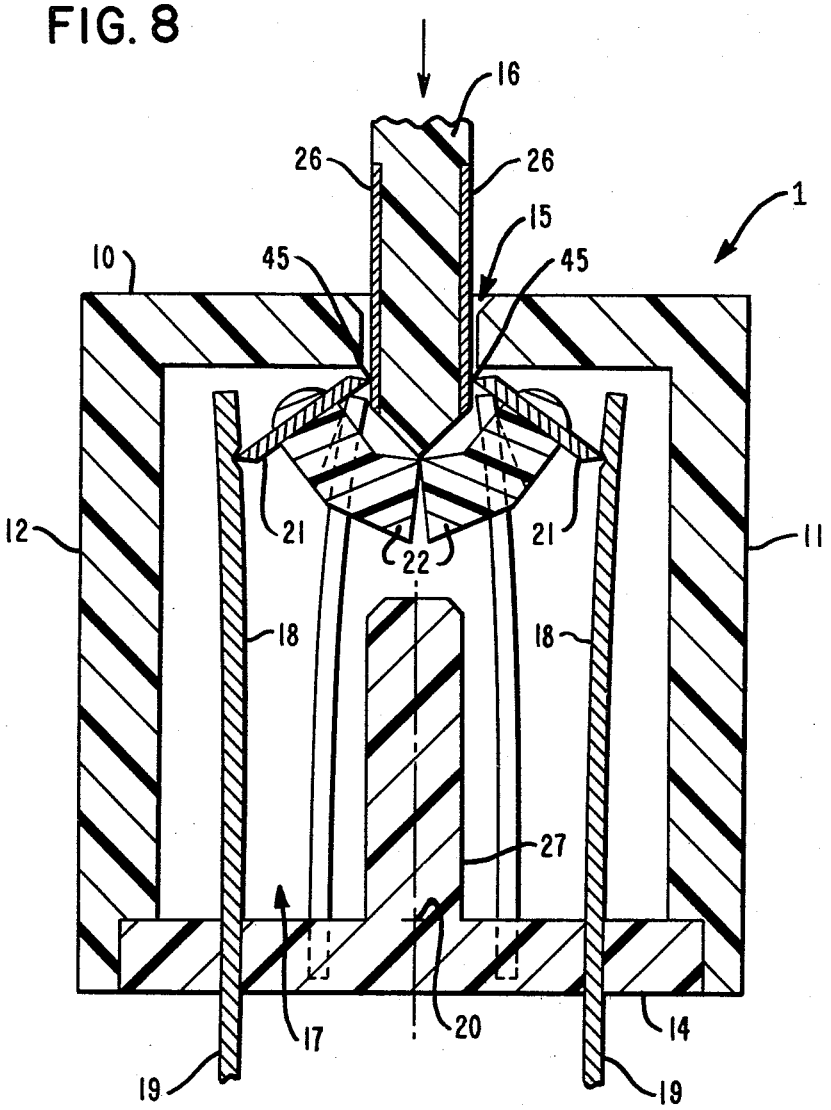
FIG. 8 is the end-view cross-section of the FIG. 7 connector with the printed circuit board partially inserted.

FIG. 8 shows the connector 1 in which the PCB 16 has traveled a sufficient distance to cause rotation of the carriers 22 such that the edges of the levers 21, which were shown initially resting upon the inner surface of top wall 10, are presently making contact at contact points 45 with their corresponding edge contacts 26 (or terminal strips) of PCB 16. Such rotation also causes a force against pins 18 by lever 21, thereby deflecting the pins 18 from the initial or ready state. As PCB 16 is further inserted into connector 1, the leading edge of PCB 16 continues to push against carriers 22, and together with the contact point 45 made between levers 21 and edge contacts 26, the carriers 22 are rotated further, the initial contact points 45 being maintained throughout insertion of PCB 16 by the knifelike action of the sharp edges of levers 21.

Figure 9:
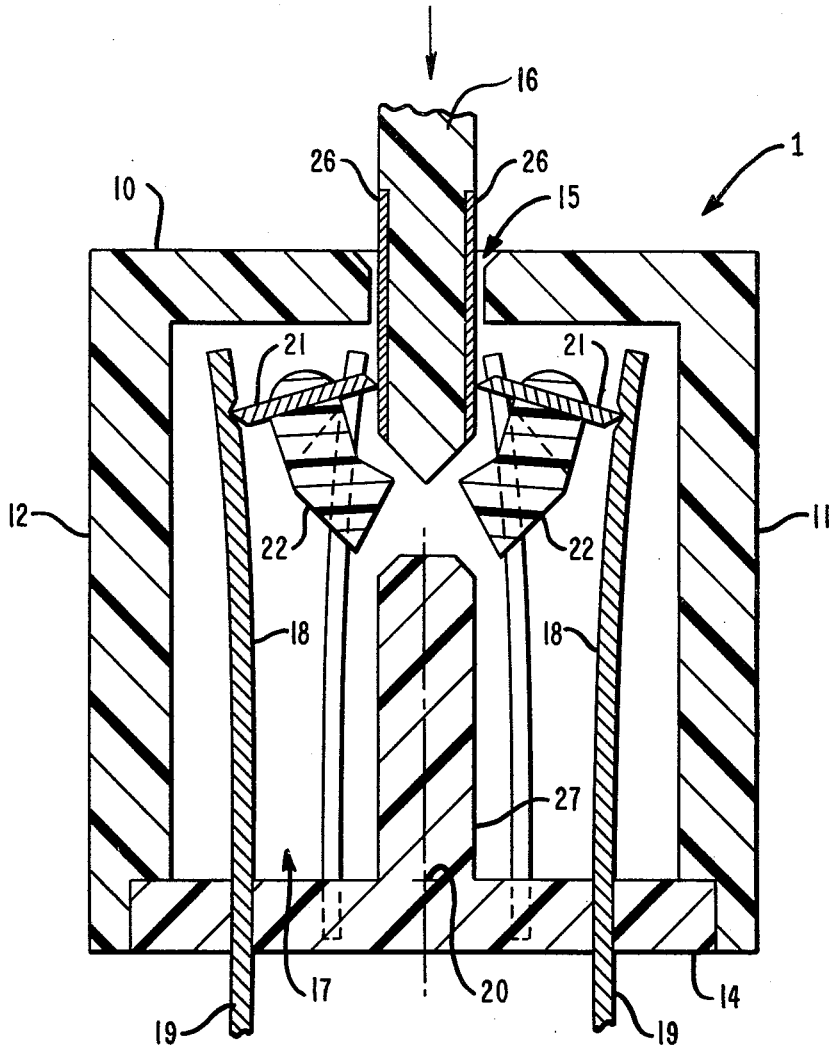
FIG. 9 is the end-view cross-section of the FIG. 7 connector with the printed circuit board inserted further than shown in FIG. 8.
Figure 10:
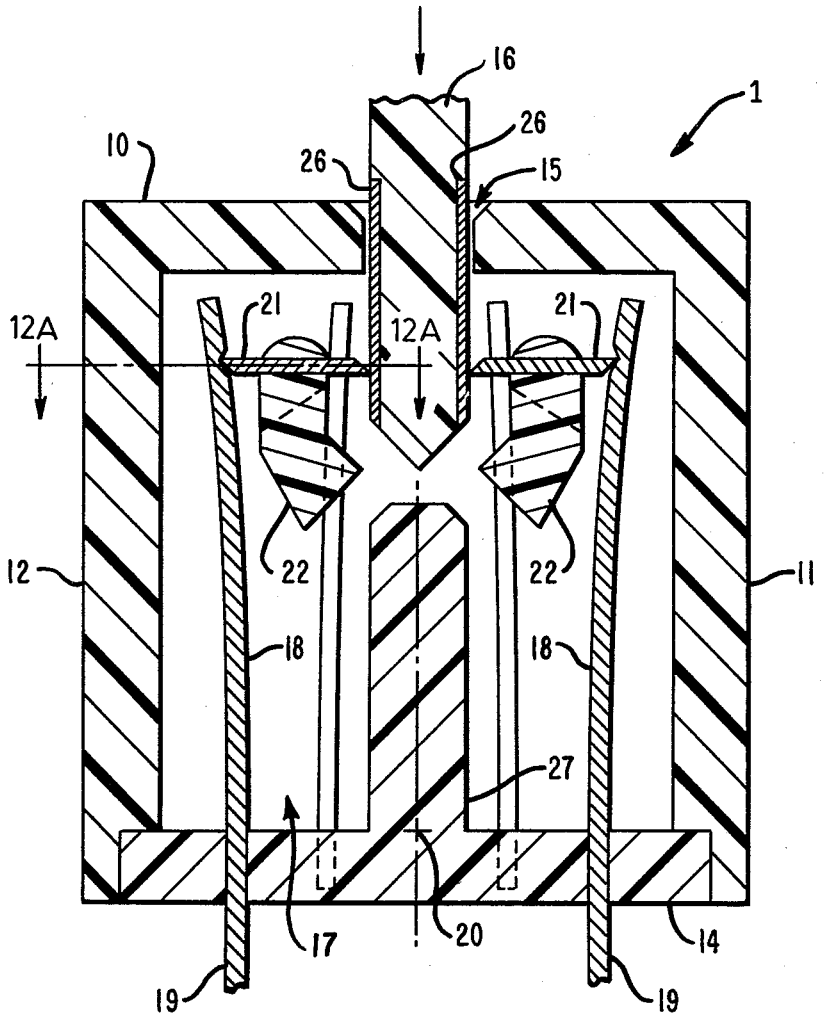
FIG. 10 is the end-view cross-section of the FIG. 7 connector with the printed circuit board inserted further than shown in FIG. 9.
Figure 11:
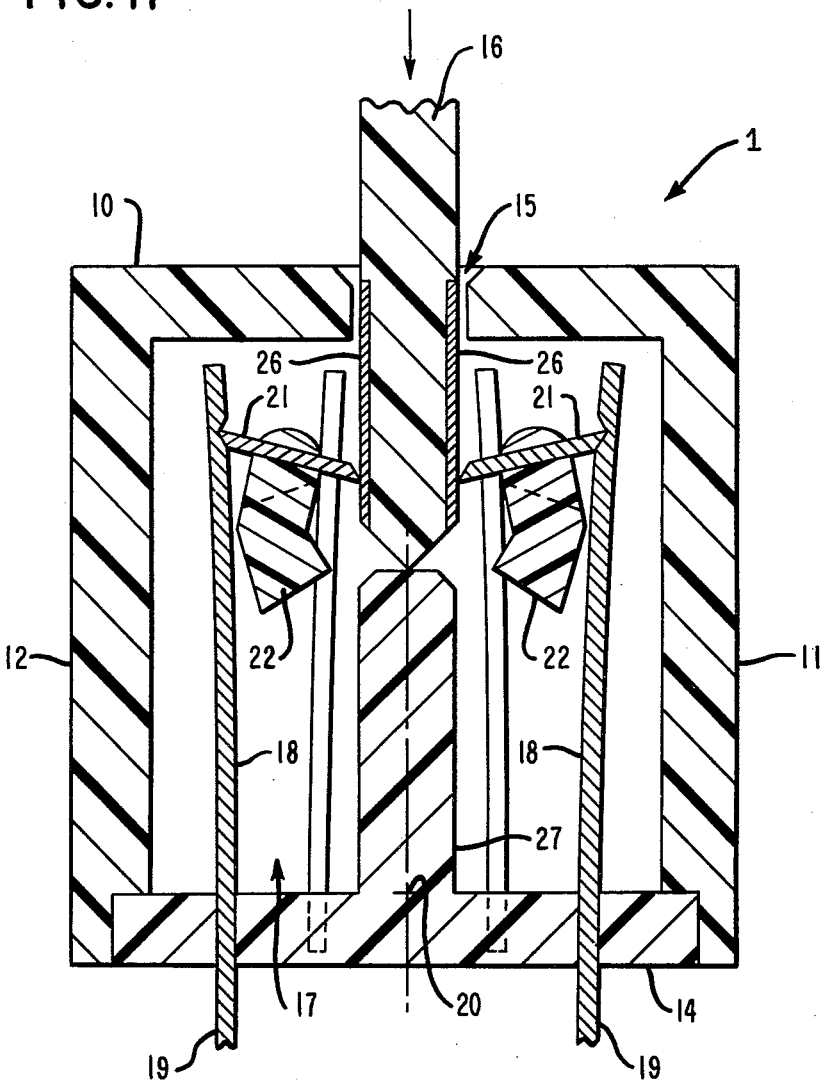
FIG. 11 is the end-view cross-section of the FIG. 7 connector with the printed circuit board fully inserted.

FIGS. 9 and 10 show interim positions of PCB travel during insertion and FIG. 11 shows the PCB 16 fully inserted, the PCB 16 travel being stopped by a block 27. It will be recognized by those skilled in the art that alternative means may be included for stopping the PCB 16 travel, including a step 34 in groove 33 (reference FIG. 6). FIG. 10 shows the levers 21 having rotated perpendicular to the PCB 16 causing the maximum deflection of pins 18. From a lever position beyond the perpendicular, there exists a small component of force along the PCB 16 travel path which results in a latching action of the PCB 16. The force required for insertion is that force required to overcome the small force component along the PCB travel path. It can be seen that the sharp points or edges at each end of the levers along with a high contact force caused by pin 18 deflection permits an action which pierces the oxide layer of the edge contact 26 thus allowing good electrical connections. It will be understood by those skilled in the art that the piercing action of the oxide layer of edge contact 26 includes actions such as friction, rubbing, knifing, cutting, etc., achieved by the lever 21 ends having alternative configurations mentioned above.

Figure 12A:
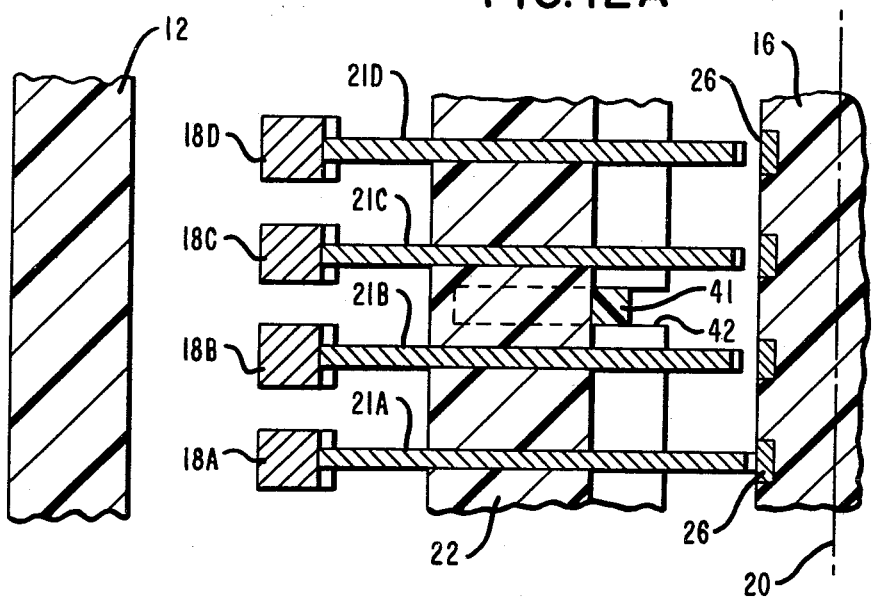
FIGS. 12A and 12B are a cross-sectional view of a partial connector taken along section line 12A—12A of FIG. 10.
Figure 12B:
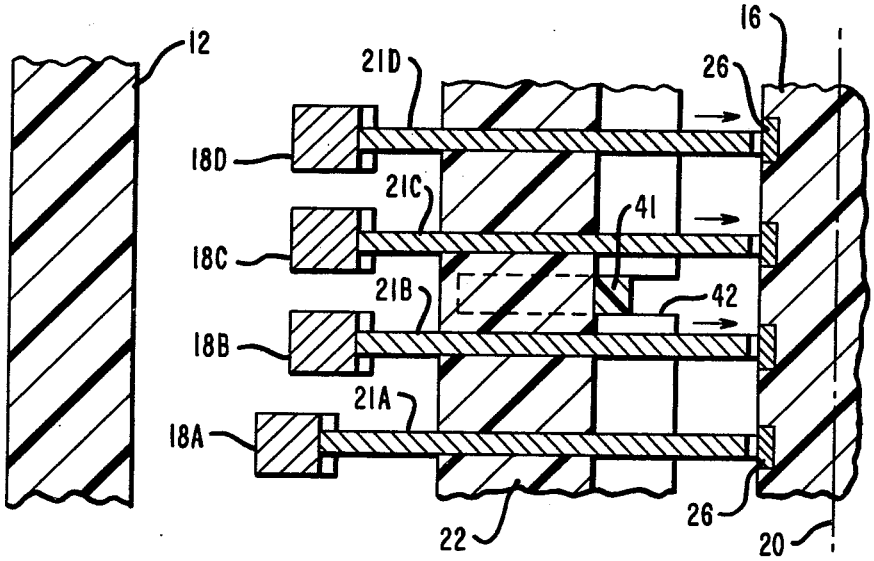

FIGS. 12A and 12B are a cross-sectional view of a partial connector 1 taken along section line 12A—12A of FIG. 10. FIG. 12A shows levers 21A through 21D mounted in carrier 22 and by some error, shows lever 21A extending farther out of carrier 22 than levers 21B, 21C, and 21D on the side making contact with PCB 16. In such case, lever 21A has created a high-spot thereby preventing levers 21B, 21C, and 21D from making any contact with their corresponding edge contacts 26. Pins 18A through 18D press against their respective levers 21A through 21D, pin 18A being the only pin benefitting from the cantilever action. In an alternative embodiment, in order to correct for the error or to compensate for manufacturing tolerances, the levers 21 can be loosely fitted into the carrier 22, permitting the lever 21 to travel along its length, as indicated by the arrows of FIG. 12B, within the carrier 22. In this manner the lever 21 is responsive to the cantilever action of its respective pin 18 nullifying the effect of the high-spot.

While there has been shown what is considered to be the preferred embodiment of the invention, it will be manifest that many changes and modifications can be made therein without departing from the essential spirit and scope of the invention. It is intended, therefore, in the annexed claims, to cover all such changes and modifications which fall within the true scope of the invention.

I claim:

1. An electrical connector for connecting to an edge contact of a printed circuit board or the like comprising:

(a) a housing having a longitudinal slot for receiving an edge of a printed circuit board;

(b) a pin made of an electrically conductive resilient material;

(c) interconnection means for operatively connecting said pin to said edge contact, said inteconnection means rotatably positioned within said housing and actuated by an insertion of the printed circuit board or the like, said interconnection means being configured to have two ends such that the first end of said interconnection means makes a first contact point with said edge contact when said interconnection means is actuated by the insertion of said printed circuit board or the like, said interconnection means rotating as said printed circuit board or the like is further inserted, and the second end of said interconnection means makes a second contact point with said pin, the second end of said interconnection means causing said pin to be deflected as a result of the rotating motion of said interconnection means, said deflection causing a force to be transmitted through said first and second contact points, thereby permitting a piercing action to occur at said first and second contact points; and (d) means for applying a force to said interconnection means to return said interconnection means to an unrotated position, said means for applying being effectively inoperative when the printed circuit board or the like is acting in concert with said electrical connector.

2. An electrical connector for connecting to an edge contact of a printed circuit board or the like comprising:

(a) a housing having a longitudinal slot for receiving an edge of a printed circuit board;

(b) a pin made of an electrically conductive resilient material;

(c) interconnection means for operatively connecting said pin to said edge contact, said interconnection means rotatably positioned within said housing and actuated by an insertion of the printed circuit board or the like, said interconnection means being configured to have two ends such that the first end of said interconnection means makes a first contact point with said edge contact when said interconnection means is actuated by the insertion of said printed circuit board or the like, said interconnection means rotating as said printed circuit board or the like is further inserted, and the second end of said interconnection means makes a second contact point with said pin, the second end of said interconnection means causing said pin to be deflected as a result of the rotating motion of said interconnection means, said deflection causing a force to be transmitted through said first and second contact points, the rotation reaching a point such that the force contains a component providing a latching action for the printed circuit board or the like; and (d) means for applying a force to said interconnection means to return said interconnection means to an unrotated position, said means for applying being effectively inoperative when the printed circuit board or the like is acting in concert with said electrical connector.

3. An electrical connector for connecting to an edge of a printed circuit board or the like comprising:

(a) a housing having a longitudinal slot for receiving an edge of a printed circuit board;

(b) a pin made of an electrically conductive resilient material;

(c) interconnection means for operatively connecting said pin to said edge contact, said interconnection means rotatably positioned within said housing and actuated by an insertion of the printed circuit board or the like, said interconnection means being configured to have two ends such that the first end of said interconnection means makes a first contact point with said edge contact when said interconnection means is actuated by the insertion of said printed circuit board or the like, said interconnection means rotating as said printed circuit board or the like is further inserted, and the second end of said interconnection means makes a second contact point with said pin, the second end of said interconnection means causing said pin to be deflected as a result of the rotating motion of said interconnection means, said deflection causing a force to be transmitted through said first and second contact points, thereby permitting a piercing action to occur at said first and second contact points, and the rotation reaching a point such that the force contains a component providing a latching action for the printed circuit board or the like; and (d) means for applying a force to said interconnection means to return said interconnection means to an unrotated position, said means for applying being effectively inoperative when the printed circuit board or the like is acting in concert with said electrical connector.

4. An electrical connector comprising:

(a) an electrically insulative housing having two sidewalls, a front wall, a top wall, a back wall, and a base whose base centerline is along a surface of the base forming an inside surface of the electrically insulative housing, the top wall having an aperture centered in the top wall for receiving a printed circuit board or the like having a plurality of terminal strips, the electrically insulative housing further having a cavity formed by said two sidewalls, said front wall, said back wall, said top wall and said base;

(b) a plurality of electrically conductive pins arranged in two rows and being sufficiently flexible for providing a cantilever action, the two rows being along the base, parallel to and on oppposite, equidistant sides of the base centerline, each of said plurality of electrically conductive pins being affixed in and perpendicular to the base and being spaced equally apart within the row, and extending through the base a sufficient length to permit external connections to be made to said plurality of electrically conductive pins, and further extending into the cavity a sufficient length to maintain an operative connection to the corresponding terminal strip of said printed circuit board or the like when said printed circuit board or the like is fully inserted into said electrical connector;

(c) a pair of connecting means, each positioned within said cavity for completing the operative connection between each of said plurality of electrically conductive pins to a corresponding one of said terminal strips of said printed circuit board or the like, the insertion of said printed circuit board or the lke causing said connecting means to rotate thereby causing the connecting means to complete said operative connection; and (d) a pair of rods, each rod corresponding to a respective connecting means, each rod having a first end firmly affixed at a point on the base and having a second end extending beyond the connecting means such that part of a surface of the rod near the second end is in operative contact with said connecting means, the point on the base being located such that the rod is slightly deflected causing the rod to exert a force on the connecting means in a direction to insure the return of said connecting means to an unrotated position upon removal of said printed circuit board.

5. An electrical connector system comprising:

(a) a backplate;

(b) at least one printed circuit board or the like, each printed circuit board or the like having at least one edge contact; and (c) at least one electrical connector comprising:

(i) a housing having a base, and having an aperture for receiving said printed circuit board of the like, and further having a cavity within said housing;

(ii) at least one pin made of an electrically conductive resilient material extending through the base a sufficient length to permit external connections to be made to said pins, and further extending into the cavity a sufficient length to maintain an operative connection to the corresponding edge contact of said printed circuit board or the like when said printed circuit board or the like is fully inserted into the corresponding electrical connector;

(iii) at least one connecting means, each positioned within said cavity for completing the operative connection between each of said electrically conductive pins to a corresponding one of said edge contacts of said printed circuit board or the like, the insertion of said printed circuit board or the like causing said connecting means to rotate thereby causing the connecting means to complete said operative connection; and (iv) at least one rod, each rod corresponding to a respective connecting means, each rod having a first end firmly affixed at a point on the base and having a second end extending beyond the connecting means such that a surface along the axis of the rod near the second end is in operative contact with said connecting means, the point on the base being such that the rod is slightly deflected causing the rod to exert a force on the connecting means in a direction to insure the return of said connecting means to an unrotated position upon removal of said printed circuit board;

the electrical connectors being affixed to the backplate, the pins of each connector extending through a corresponding aperture of the backplate thereby permitting the pins to be interconnected.

* * * * *